US006318560B2

(12) United States Patent
Davis

(10) Patent No.: US 6,318,560 B2
(45) Date of Patent: Nov. 20, 2001

(54) REMOVABLE DISC CONSTRUCTION FOR DISC SCREEN APPARATUS

(75) Inventor: Robert M. Davis, El Cajon, CA (US)

(73) Assignee: C P Manufacturing, Inc.

( * ) Notice: Subject to any disclaimer, the term of this patent is extended or adjusted under 35 U.S.C. 154(b) by 0 days.

(21) Appl. No.: 09/785,830

(22) Filed: Feb. 15, 2001

Related U.S. Application Data

(62) Division of application No. 09/246,999, filed on Feb. 8, 1999, now Pat. No. 6,250,478.

(51) Int. Cl.[7] ..... B07B 13/05; B07B 13/07
(52) U.S. Cl. ..... 209/672; 209/667; 209/671
(58) Field of Search ..... 198/780; 193/37; 209/672, 671, 667

(56) References Cited

U.S. PATENT DOCUMENTS

| | | | | |
|---|---|---|---|---|
| 1,621,695 | * | 3/1927 | Tuite et al. | 209/668 |
| 1,641,777 | * | 9/1927 | Newhouse | 209/672 |
| 1,679,593 | * | 8/1928 | Williamson et al. | 209/672 |
| 1,699,718 | * | 1/1929 | Robins | 209/672 |
| 2,266,506 | * | 12/1941 | Morse | 209/671 |
| 2,588,309 | * | 3/1952 | Troyer | 209/667 |
| 2,860,766 | | 11/1958 | Welter | 198/780 |
| 2,949,189 | * | 8/1960 | Haines | 209/671 |
| 2,983,376 | * | 5/1961 | Troyer | 209/627 |
| 3,306,441 | * | 2/1967 | Sanders et al. | 209/672 |
| 3,519,129 | * | 7/1970 | Peterson | 209/931 |
| 3,642,520 | * | 2/1972 | Lazzarini | 426/308 |
| 4,402,390 | | 9/1983 | Feeney | 193/37 |
| 4,724,950 | * | 2/1988 | Okamura | 198/780 |
| 4,795,036 | * | 1/1989 | Williams | 209/667 |
| 5,035,314 | * | 7/1991 | Kornylack | 193/37 |
| 5,279,427 | * | 1/1994 | Mobley | 209/668 |
| 5,352,469 | * | 10/1994 | Peters | 426/478 |
| 5,450,966 | | 9/1995 | Clark et al. | 209/672 |
| 5,697,704 | * | 12/1997 | Coyle | 366/301 |
| 5,868,036 | | 2/1999 | Salzman | 74/450 |
| 5,931,312 | * | 8/1999 | Gifford | 209/665 |
| 5,960,964 | | 10/1999 | Austin et al. | 209/672 |
| 6,076,684 | * | 6/2000 | Bollegraaf | 209/668 |
| 6,149,018 | * | 11/2000 | Austin et al. | 209/672 |
| 6,234,322 | * | 5/2001 | Paladin | 209/667 |

FOREIGN PATENT DOCUMENTS

| | | | |
|---|---|---|---|
| 2054615 | 1/1999 | (CA) | B07B/1/08 |

* cited by examiner

*Primary Examiner*—Donald P. Walsh
*Assistant Examiner*—Daniel K Schlak
(74) *Attorney, Agent, or Firm*—Michael H. Jester

(57) ABSTRACT

A disc screen apparatus is disclosed for separating mixed recyclable materials of varying sizes and shapes. The disc screen apparatus has an enclosure or frame with an input, a container discharge location and a paper discharge location. A first plurality of shafts and second plurality of shafts are rotatably supported by the frame. The first plurality of shafts form a first disc screen disposed in a first plane and the second plurality of shafts form a second disc screen at least a portion of which is disposed in a second plane. The second plane is disposed beneath and angled with respect to the first plane such that the planes at least partially overlap. One or more motors rotate the first and second plurality of shafts. Each shaft has a plurality of discs positioned along it. The discs are offset between adjacent shafts such that discs on each shaft interleave with discs on an adjacent shaft but do not touch the adjacent shaft. The discs are substantially square in shape with radiused corners. The radiused corners have a texture, such as ridges. The arrangement of the discs on the shafts creates a screening pattern capable of screening a portion of the mixed recyclable materials. Each disc is assembled about a shaft from two identical portions. The portions are clamped together, about the shaft to form the disc. If the disc is damaged or worn, it may be removed from the shaft for repair or replacement without disassembly of the shaft from the apparatus or removal of other discs. The discs are also disclosed as comprising an inner rigid frame supporting an outer, softer material.

15 Claims, 7 Drawing Sheets

REMOVABLE DISC CONSTRUCTION FOR DISC SCREEN APPARATUS

This application is a division of U.S. patent application Ser. No. 09/246,999 filed Feb. 8, 1999, and patented on Jun. 26, 2001 as U.S. Pat. No. 6,250,478 B1.

BACKGROUND OF THE INVENTION

The invention is in the field of machines for processing recyclable material, and particularly concerns machines that separate paper, bulk containers, broken glass and other materials.

More specifically, the invention relates to a disc screen apparatus for classifying material in a stream of heterogeneous materials. More specifically still, the invention concerns a disc screen apparatus with discs that may be mounted to and removed from the apparatus without disassembly of the apparatus.

Material recycling has become an important industry in recent years due to decreasing landfill capacity, environmental concerns and the dwindling of natural resources. Many industries and communities have adopted voluntary and mandatory recycling programs for reusable materials. Solid waste and trash that is collected from homes, apartments or companies often combine the recyclable materials into one container, usually labeled "RECYCLABLE MATERIAL". Recyclable materials include newspaper, magazines, aluminum cans, glass bottles and other materials that may be recycled. When brought to a processing center, the recyclable materials are frequently mixed together in a heterogenous mass of material. Ideally, the mixed materials should be separated into common recyclable materials (i.e., papers, cans, etc.).

Disc screens are increasingly used to separate heterogeneous streams of recyclable material into respective streams or collections of similar materials. This process is referred to as "classifying", and the results are called "classification".

A disc screen apparatus typically includes a frame in which a plurality of rotatable shafts are mounted in parallel. A plurality of discs are mounted on each shaft and means are provided to rotate the shafts commonly in the same direction. The discs on one shaft interleave with the discs on an adjacent shaft to form screen openings between the peripheral edges of the discs and structures on the adjacent shaft. The sizes of the openings determine the size (and thus the type) of material that will fall through the screen. Rotation of the discs carries the larger articles along or across the screen in a general flow direction from an input where a stream of material pours onto the disc screen to an output where those articles pour off of the disc screen.

In disc screen apparatuses that are used for classification of recyclable materials I have found that the heavy continuous flow of recyclable material tends to result in quick wear and a significant degree of damage to the discs, requiring a high level of maintenance and repair. My observation is that the discs are typically slidably engaged to their shafts, fixed in their positions by spacers, and retained in the shafts by clamping applied to the ends of the shafts. Therefore, to replace a damaged disc, the shaft on which the disc is mounted must be disassembled from the screen, the disc slid off the shaft and replaced, and the shaft reassembled to the screen. Much time is consumed in this process.

SUMMARY OF THE INVENTION

The invention is based upon the critical realization that a disc for a disc screen apparatus can be provided in two (or more) matching pieces having opposing surfaces that are clamped together around a shaft. When damaged, the matching pieces are separated, removed from the shaft and replaced by the pieces of another, undamaged disc.

In connection with this objective, the invention is directed toward provision of a disc that can be attached to and removed from the shaft of a disc screen apparatus without disassembling the shaft from the screen apparatus.

Other objects and advantages of the invention will become apparent when the following detailed description is read with reference to the below-described drawings.

DETAILED DESCRIPTION OF THE PREFERRED EMBODIMENT

Figure 1:
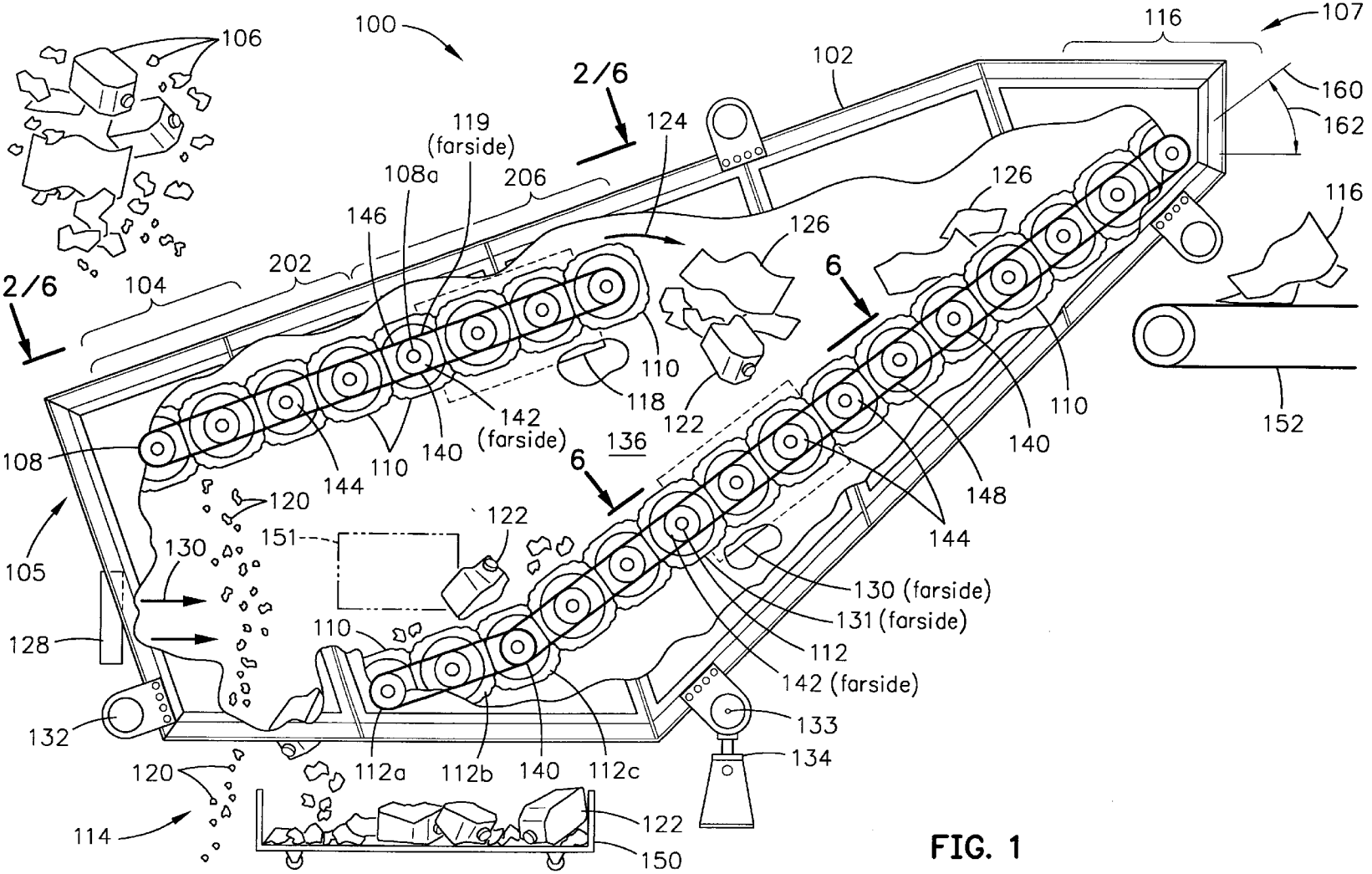
FIG. 1 is a side view of a disc screen machine that embodies the invention.

My invention is a disc screen apparatus ("hereinafter "apparatus") that separates mixed recyclable materials, of various sizes and shapes, including paper, magazines, plastic or aluminum containers and the like. The apparatus, indicated generally by 100, includes a frame (or housing) 102, having a first plurality of rotatable shafts 108 ("first rotatable shafts") and a second plurality of rotatable shafts 112 ("second rotatable shafts") rotatably supported in the frame 102. A first motor 118 mounted on the frame 102 is coupled to a drive chain 119 that imparts a rotational force to the first rotatable shafts 108, while a second motor 130, also mounted on the frame 102, is coupled to a drive chain 131 that imparts a rotational force to the second rotatable shafts 112.

Preferably, the frame 102 is constructed using durable, heavy duty materials, such as steel. The precise shape of the frame 102, and its structure and layout, are subject to the design considerations and operational constraints of any particular application. However, in this example the frame 102 is a generally closed structure with an mixed material input area 104, container discharge area 114 and a paper discharge area 116.

Although the frame 102 forms an enclosure, this is not absolutely necessary to the invention, but it may be required for safety reasons. The mixed material input area 104 is generally located near a first end 105 of the frame 102, where a heterogenous material stream 106 of recyclable materials enters the apparatus. As can be seen in FIG. 1, the material stream 106 travels through the mixed material input area 104, and falls onto the first rotatable shafts 108. The first rotatable shafts 108 rotate in such a direction that the material stream 106 travels from the first end 105 of the apparatus toward a second end 107 of the apparatus in a general flow direction. Mounted on the first rotatable shafts 108 are a plurality of discs 110 that both agitate and propel the material stream 106. The discs 110 may be spaced on the shafts in a variety of patterns. Depending on the patterns of the discs 110, the material stream 106 starts to separate in one way or another. In this manner, the first rotatable shafts 108 with discs 110 act as a first disc screen. (Hereinafter, these terms are interchangeable.) In the preferred embodiment, the discs 110 are positioned in the first disc screen so that the material stream 106 is initially screened, with small materials 120 passing through the openings and larger materials continuing along the first rotatable shafts 108, all the while being agitated by the discs 110. At the end of the plane of first rotatable shafts 108, the larger materials fall onto the second rotatable shafts 112 (the direction shown as arrow 124). Mounted on the second rotatable shafts 112 are a plurality of discs 110. Thus, the second rotatable shafts with discs 110 act as a second disc screen, and these terms are interchangeable hereinafter. The discs 110 may be mounted on the second rotatable shafts in a variety of patterns. The second rotatable shafts 112 are generally positioned in an inclined plane 160 that has an angle 162. This inclined arrangement of the second rotatable shafts 112 allows heavier objects 122, such as bottles and cans, to bounce on the discs 110 and tumble backward and downward toward the container discharge area 114, finally falling out of the container discharge area 114 into a container or plenum 150. Lighter material such as cardboard and paper falling on the second disc screen does not bounce and is carried toward and upwardly to the paper discharge area 116. To assist in propelling the paper 126 toward the paper discharge area 116, one or more fans 128 may be mounted near the first end 105 of the frame to blow air 130 at the second rotatable shafts 112.

Figure 2C:
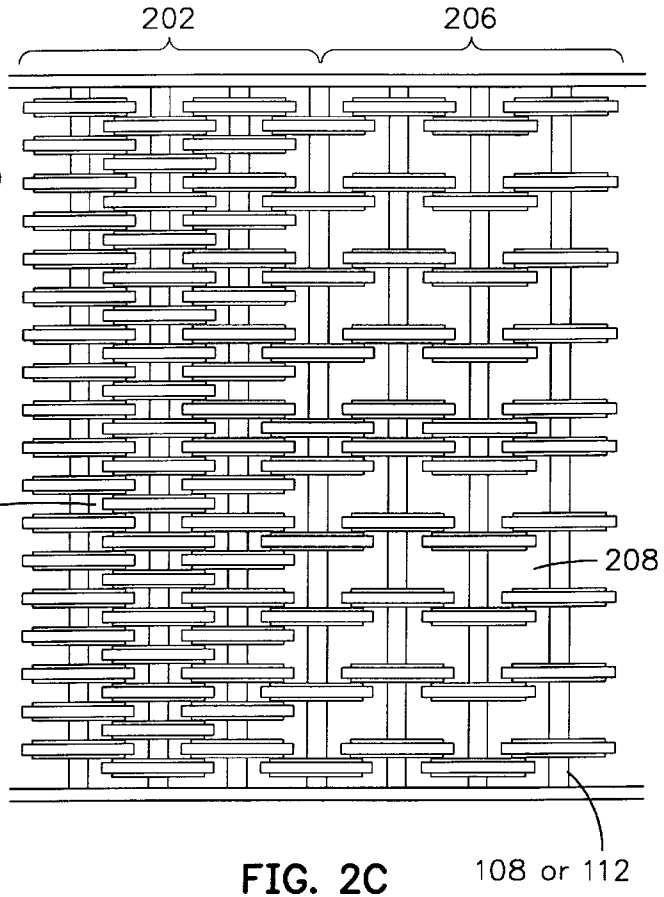
FIGS. 2A–2C are top views of rotatable shafts and discs showing different screen configurations.
Figure 2B:
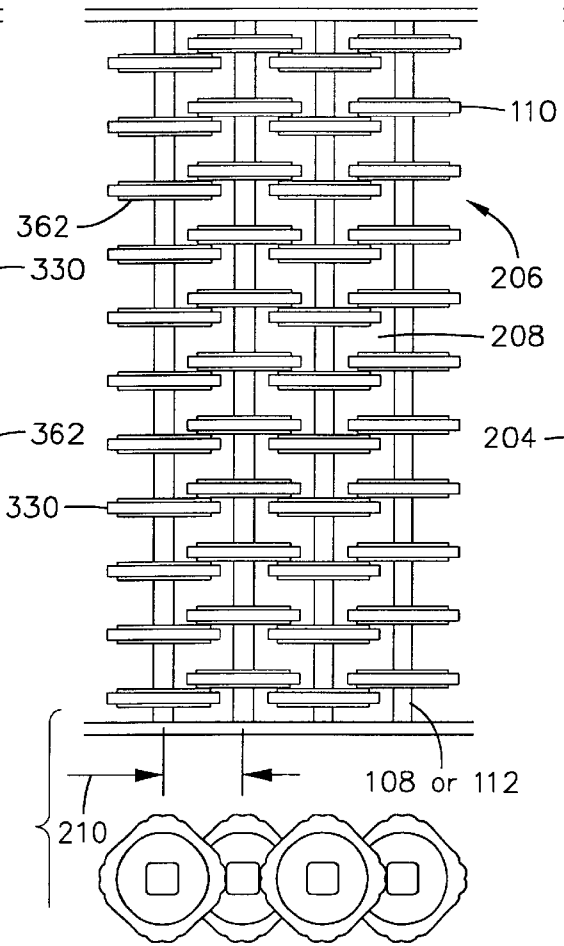
Figure 2A:
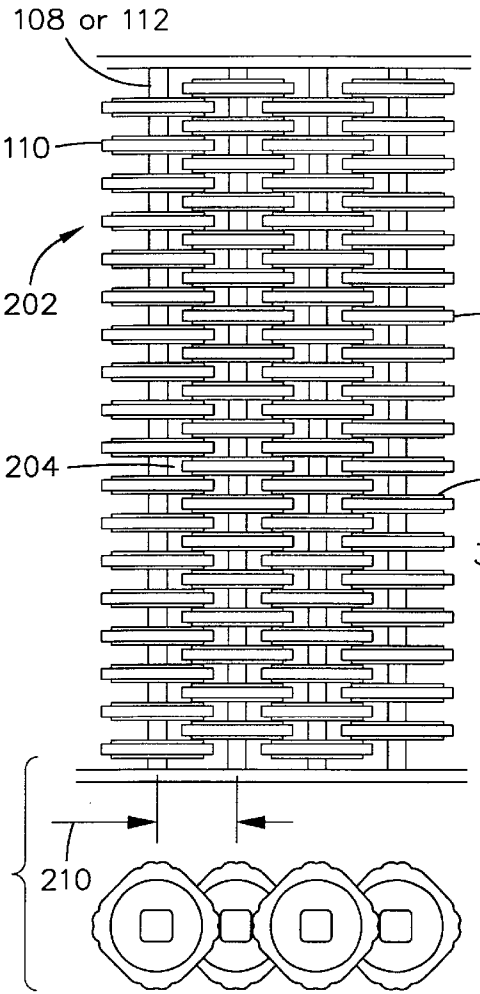

FIGS. 2A, 2B and 2C show examples of the discs 110 mounted on the first and second rotatable shafts 108 and 112, with varied spacing, creating a variety of screen patterns. FIGS. 2A and 2B show examples of two screen patterns 202 and 204 of the discs 110 mounted on the first rotatable shafts 108. FIG. 2A shows the discs 110 mounted on the shaft in a fine screen pattern, with small spaces between the edges of the discs 110 and adjacent shafts. One such space is indicated by 204. This fine screen pattern 202 is used in the apparatus where small materials are screened. In FIG. 2B, the discs 110 are mounted in a gross screen pattern 206 with large openings such as 208 such that larger, heavier materials are able to fall through the openings 208 between the discs 110. In some cases, it may be desirable to have a combination of spacings between the discs (i.e., have both small openings 204 and large openings 208). In this way, as the material stream travels along a plurality of rotating shafts, the mixed material is separated and screened in successive stages on one disc screen. One example combination pattern formed by varying the screen patterns is shown in FIG. 2C. In fact, this pattern describes the layout of the first disc screen. In this regard, as the material stream pours onto the disc screen apparatus in the inlet are 104 on the fine screen pattern 202, the material stream is agitated and moved by rotation of the discs with the shafts toward and over the gross screen pattern 206. Over the fine screen pattern 202, relatively fine grit, glass shards, and other small materials are screened out. Over the gross screen pattern 206, larger objects such as cans, bottles, and envelopes pour through the larger openings onto the lower end of the second rotatable shafts 112. In the preferred embodiment, the entire second disc screen has the gross screen pattern 206 of FIG. 2B.

In the apparatus 100, the first and second rotatable shafts 108 and 112 extend through and are supported between sides 136 (near side shown in FIG. 1) and 138 (far side) of the frame 102. The first rotatable shafts 108 are located in a first plane and the second rotatable shafts 112 are located below and partially underneath the first rotatable shafts 108 in an overlapping manner, with the first three shafts 112*a*, 112*b*, and 112*c* defining a plane that is parallel to that of the first rotatable shafts 108, and the remaining twelve defining a second plane. In the preferred embodiment, the first plane is generally disposed at a slight incline from horizontal to assist in the initial separation of the material stream 106. The first plane angle may vary from 0 to 45 degrees, with the preferred embodiment angle being 20 degrees. The second plane is generally disposed at an inclined angle such that the larger objects 122 do not readily go up the incline. The angle may vary from 25 to 60 degrees with the preferred embodiment angle being 35 to 45 degrees. In one embodiment, the frame 102 is mounted at a fixed first point 132 and a rotatable second point 133. The frame 102 may be rotated up or down, with the first point 132 as the pivot point, to alter an incline angle of the frame 102 using a jack 134 at the second point 133. This rotation of the frame up or down may also be used to vary the angles of the shafts.

The number of shafts is dependent on the size of the machine 100 and on intershaft spacing. In the embodiment shown in FIG. 1, the number of shafts in the first plurality of rotatable shafts 108 is less than the number of shafts in the second plurality of rotatable shafts 112. In the FIG. 1, there are eight first rotatable shafts 108 and fifteen second rotatable shafts 112. The first shafts 108 and second shafts 112 are supported by bushings or bearings 140 positioned along sides 136 and 138.

The plurality of discs 110, made from a hard durable material with a high coefficient of friction, such as rubber, are mounted on the first rotatable shafts 108 and the second rotatable shafts 112 to form the screen patterns shown in FIGS. 2A–2C; however, the discs 110 may be mounted along the first rotatable shafts 108 and the second rotatable shafts 112 in a variety of spacing patterns. The discs 110 on adjacent shafts are offset on their respective shafts such that the discs 110 on one shaft fit between (interleave with) the discs on the other shaft without touching the other shaft. This is best seen in FIGS. 2A–2C.

Figure 6:
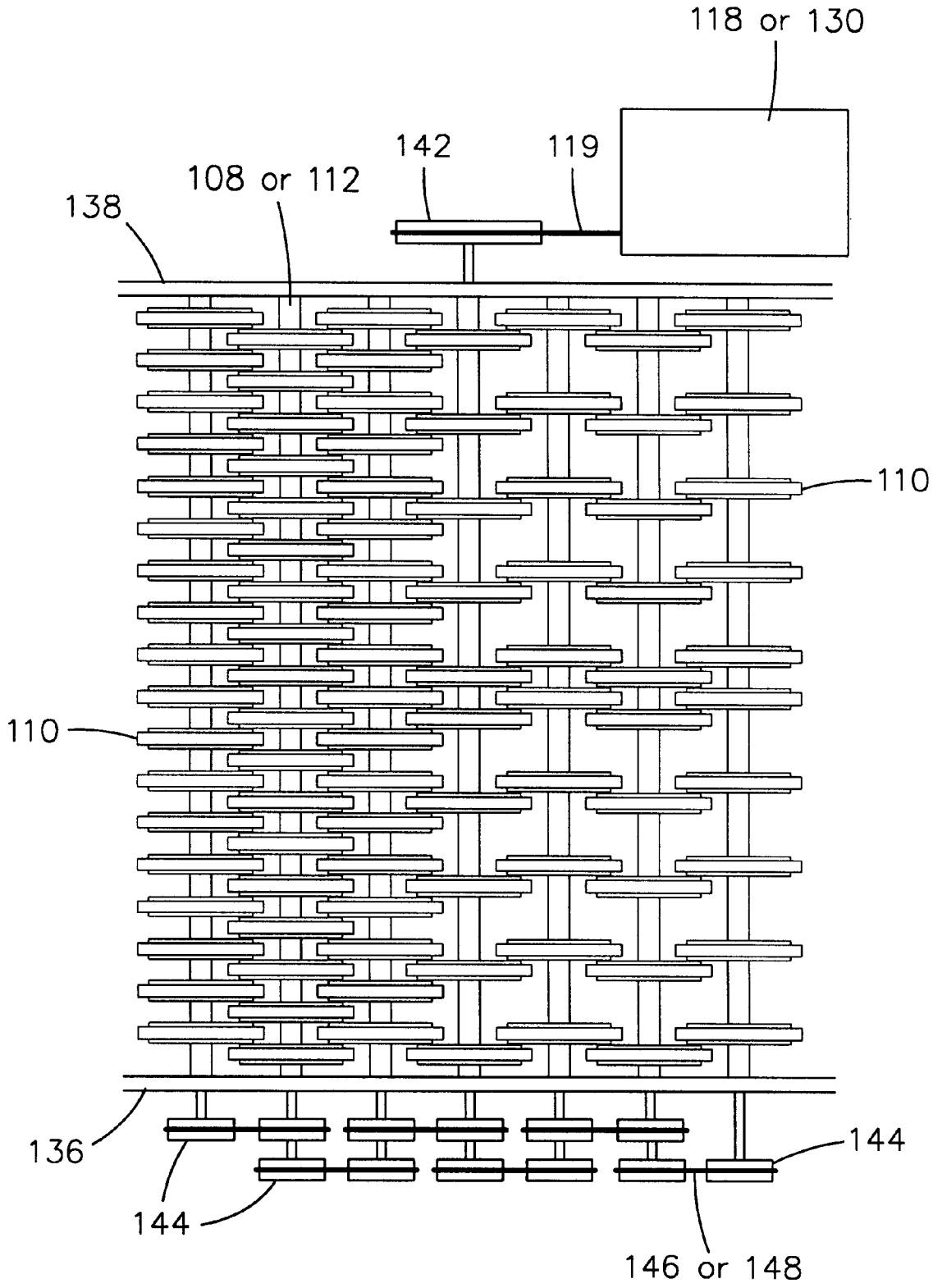
FIG. 6 is a top view taken along 6—6 in FIG. 1 showing the relationship of the motor, rotatable shafts, pulleys and drive mechanism.
Figure 7A:
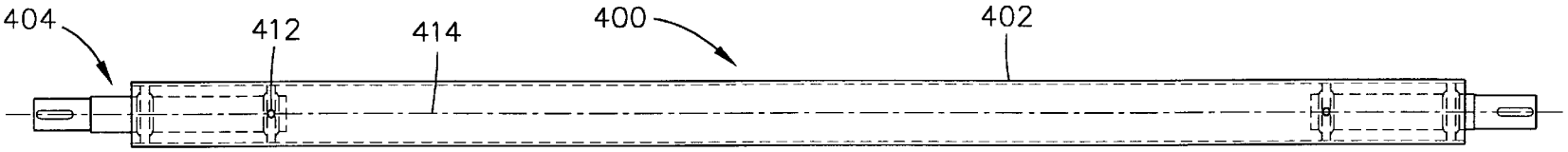
FIGS. 7A, 7B and 7C are views of a shaft assembly.
Figure 7C:
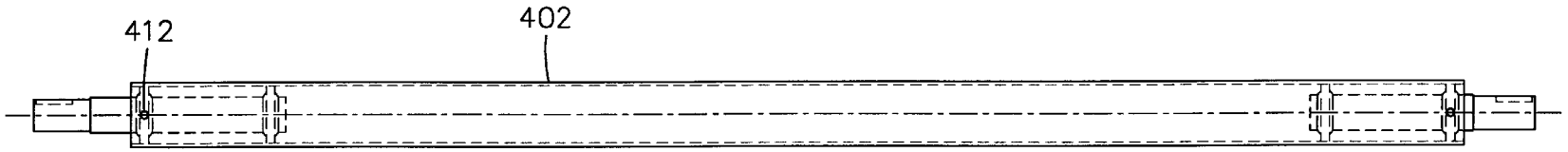
Figure 7B:
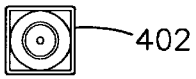
Figure 8A:
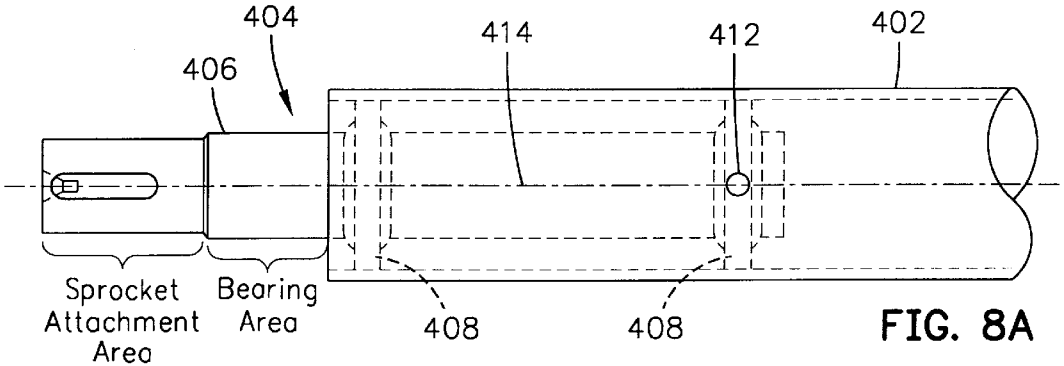
FIGS. 8A and 8B show some details of the shaft assembly in FIG. 7.
Figure 8B:
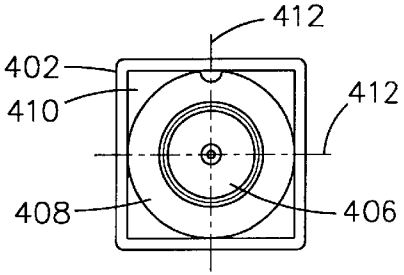

Referring again to FIGS. 1 and 6, in the preferred embodiment, the first motor 118 and second motor 130 are positioned on the side 138 (far side) of the frame 102. The motors 118 and 130 are shown with dashed lines. A drive chain 119 attaches between the motor 118 and a drive sprocket 142 mounted on the end of the first shaft 108*a* that is on the side of 138 (far side). A plurality of rotation sprockets 144 are mounted at the end of each first shaft 108, that is on the side 136 (near side). A rotation chain 146 interconnects the plurality of rotation sprockets 144, as shown in FIG. 1. A drive chain 131 attaches between the motor 130 and a drive sprocket 142 on the end of the second shaft 112 that is on the side 138 (far side). A plurality of rotation sprockets 144 are located at the end of each second shaft 112 on side 136 (near side). A rotation chain 148 interconnects the plurality of rotation sprockets 144. Safety covers (not shown) cover the plurality of rotation sprockets and rotation chains. There may also be access doors or panels 151 on the sides 136 and 138 to allow access or viewing of the interior of the machine.

The first motor 118 turns the drive chain 119 and drive sprocket 142, thereby rotating the first rotatable shaft 108*a* in a first direction. Since all of the first rotatable shafts 108 are interconnected by rotation sprockets 144 and rotation chain 146, all of the first rotatable shafts 108 rotate together in the first direction at the same speed. The second motor 130 turns the drive chain 131 and drive sprocket 142, thereby rotating the second rotatable shaft 112 in a second direction. Since all of the second rotatable shafts 112 are interconnected by rotation sprockets 140 and rotation chain 148, all the second rotatable shafts 112 rotate together in the second direction at the same speed. The rotating second direction of the second rotatable shafts 112 is in the same direction as the rotating first direction of the first rotatable shafts 108. Each motor may rotate its plurality of shafts at a particular speed. In the illustrative embodiment, the rotation speed of the first rotatable shafts 108 is around 60–100 revolutions per minute (rpm) and the rotation speed of the second rotatable shafts 112 is around 200–300 rpm. Although the preferred embodiment couples the motors to the shafts by sprocket/chain drives, other couplings may be used including, but not limited to, transmission couplings, geared couplings, direct couplings, and so on. Alternatively, separate individual shafts may be powered by separate individual motors. Further, the motors may be stationed at positions other than those shown, both on and off the frame 102 as design and installation considerations dictate. The sizes of the motors are dependent on a number of factors such as the number of rollers, type of drive mechanism, and so on. For example, each may have a rating of around 3 HP, with a 90 degree worm drive.

The operation of the disc screen apparatus 100 is as follows. Initially, the material stream 106 pours upon the first disc screen in the material entry area 104. In the fine screen section 202 of the first disc screen, the material stream is agitated and small matter is screened out, falling downwardly through the apparatus 100 to be collected by conventional means. The material stream 106 is propelled upwardly by the rotation of the discs toward, over, and off of the gross screen section 206. As it passes over the gross screen section 206, intermediate-sized objects such as cans, twelve-ounce bottles and envelopes fall through the gross mesh onto to the lower end of the second rotatable shafts 112. Meanwhile, the larger objects including large containers, newspapers, and cardboard sections of the material stream 106 are propelled off the upper end of the first disc screen onto the midsection of the second disc screen. Thus, the material stream 106 pours onto the second disc screen for screening already in a somewhat differentiated state, with smaller objects falling onto the lower rear portion of the second disc screen, and larger objects onto its midsection. The smaller objects are screened at the lower portion of the second disc screen, either passing through the gross screen pattern into the plenum 150 or tumbling downwardly off the lower end of the second disc screen into the plenum 150. The larger objects that pour onto the midsection of the second disc screen separate, with the larger, heavier objects such as large bottles and plastic containers being bounced off the screen and rolling downwardly toward the lower end of the second disc screen from which they fall into the plenum 150. Meanwhile, the larger light objects such as newspapers, magazines, and cardboard sections are carried upwardly by rotation of the second rotatable shafts 112 toward, over, and off of the upper end of the second disc screen from which they fall onto a collection conveyor 152. A distinct advantage of this operation is that the material stream 106 is classified essentially into three sections on the first disc screen. Advantageously, the second disc screen receives a material stream that has been partially classified into smaller heavier objects that pour onto the lower portion of the second disc screen and a mixture of larger heavy and light objects that pour onto the second disc screen in its midsection. This avoids the prior art problem of a single, large, very dense stream of material pouring onto a single disc stream, creating a large eddying slurry of undifferentiated material at its impact point. As is known, such a large slurry reduces the effectiveness of a disc screen, providing less sharply differentiated collections of material than are afforded by the apparatus 100.

Figure 3A:
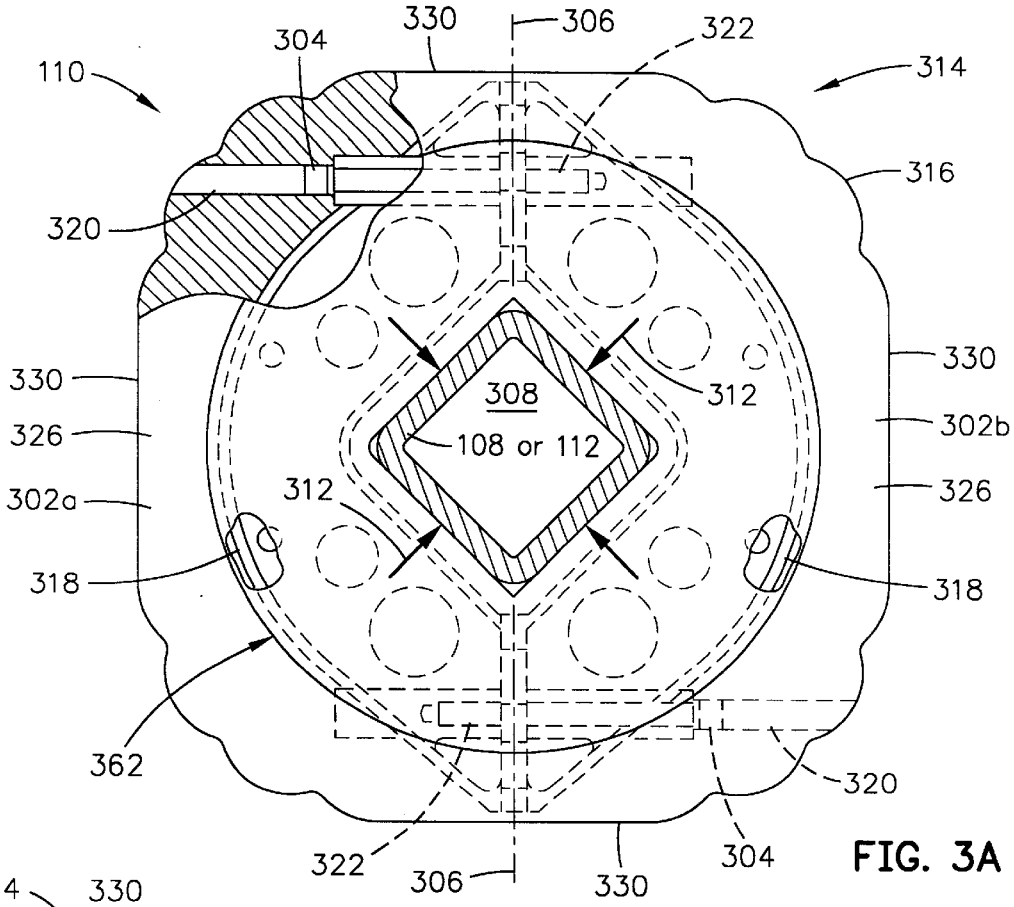
FIG. 3A is a side elevation view of a disc, with a portion cut away, showing certain elements with hidden lines.
Figure 3B:
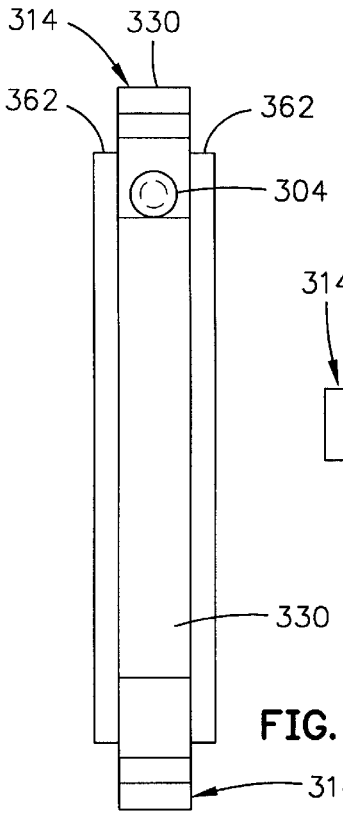
FIG. 3B is an elevation view of an edge of the disc of FIG. 3A.
Figure 3C:
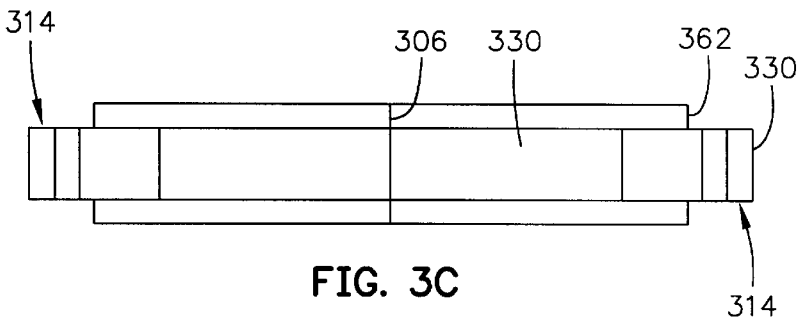
FIG. 3C is a top plan view of an edge of the disc of FIG. 3A.

FIGS. 3A–3C show details of a preferred embodiment of a disc 110. The disc 110 is designed to be replaceable on a shaft, without disassembly of the shaft and/or removal of other discs therefrom. The disc 110 is designed to separate into two portions at a separation plane 306 into disc portion 302*a* and disc portion 302*b*. Screws 304 clamp the disc halves 302*a* and 302*b* together. A central opening 308 of the disc 110 is designed to fit on the rotatable shafts 108 or 112. The central opening 308 comprises planar sections 310. As can be seen in the figures, the rotatable shafts 108 or 112 are eccentric (preferably square) in configuration. This provides more planar contact between the rotatable shaft and the disc. Because of the design of the disc 110, as the disc halves 302*a* and 302*b* are clamped around the rotatable shaft 108 or 112, the planar sections 310 make contact with the flat sides of the rotatable shafts at four clamping surfaces 312. This allows the disc 110 to clamp or grab a shaft 108 or 112 such that it will not freely spin on the shaft. This clamping design also eliminates the need for spacers or the like to be positioned between the discs 110 to create the desired screen patterns.

The disc 110 is (preferably) square in shape with an outer peripheral edge which includes four corners 314. In the illustrated embodiment, the corners 314 are radiused to reduce the wear on the disc 110 during use. The radiused corners may also be textured with a variety of patterns. This texturing may assist in the or movement of materials with the disc 110. In the illustrative embodiment shown, the corners 314 are textured with a plurality of ridges 316. The outer peripheral edge of the disc 110 defines an annular impacting surface 330. Also shown in the figures is a cylindrical shoulder 362 or boss integrally formed on and protruding from each side of the disc. The shoulder 362 allows for room between the impacting surfaces 330 of adjacent discs 110 when they are positioned in a fine mesh pattern. Further, the shoulders 362 of adjacent discs provide a lateral space within which the peripheral edge of an interleaved disc on an adjacent shaft may be received to create a small space such as the space 204 for fine material screening. (See FIG. 2A.)

For the disc 110 to function well, it must have a flexible impacting surface 330 with high abrasion resistance for impacting the materials, while at the same time having a "sticky" surface with a high coefficient of friction. There are a number of materials, such as rubber, that may be used in making the disc 110. A coating of material may also be applied to the impacting surface 330.

Figure 4A:
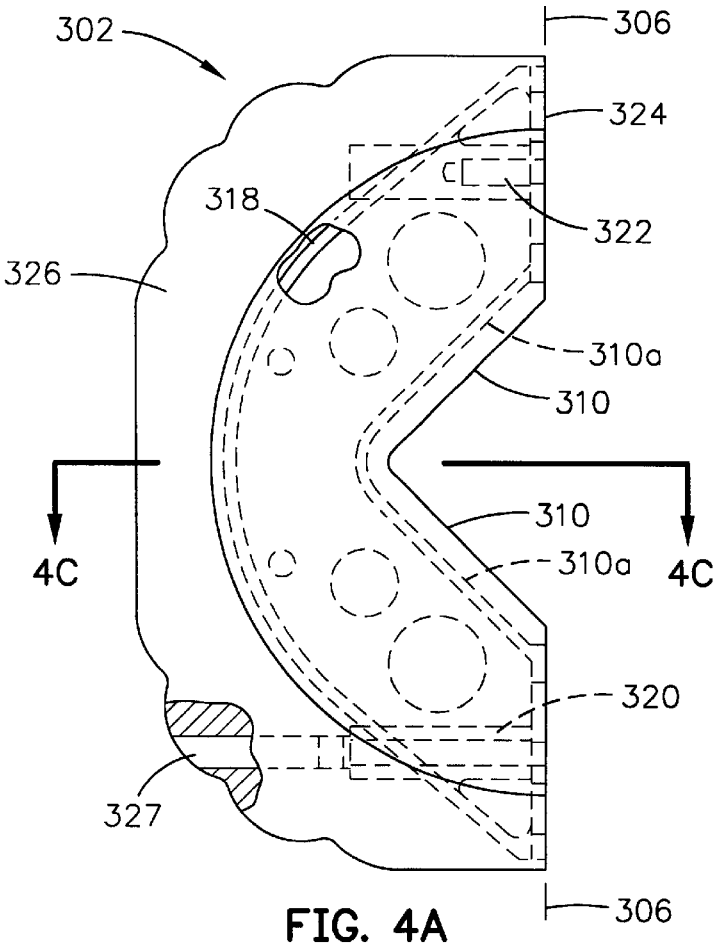
FIG. 4A is a side elevation view, with a portion cut away, of one of two pieces of the disc of FIG. 3A.
Figure 4C:
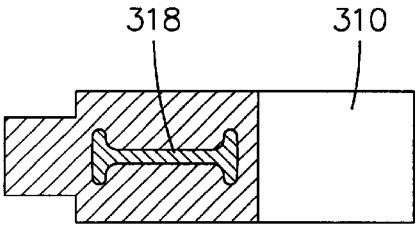
FIG. 4C is sectional view of the one piece, taken along C—C of FIG. 4A.
Figure 4B:
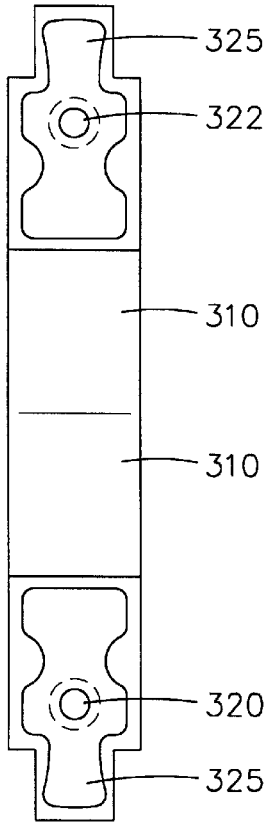
FIG. 4B is an end elevation view of the one piece of FIG. 4A.

With reference to FIGS. 3A, 4A, 4B, 5A and 5B, it should appreciated that the disc 110 comprises two identical halves, placed in opposition on a shaft and clamped thereto. Each half is referred to as a "portion". In FIG. 3A, the disc 110 includes identical opposing portions 302*a* and 302*b*. As best seen in FIGS. 4A–4C, a disc portion 302 (representing both of portions 302*a* and 302*b*) has an internal rigid frame or embedment 318 to which a rubber material 326 is molded. (Note, for accuracy, that portion 302 corresponds to portion 302*a*, with its top and bottom ends rotated 180°). Preferably, the rubber material is a 50–55 durometer rubber casting compression molded around the rigid frame 318. The rigid frame 318 imparts stiffness to the disc portion 302 and improves the clamping force 312 when two disc portions 302*a* and 302*b* are clamped to a shaft. As shown in FIG. SA and 5B, the rigid frame 318 includes a first unthreaded through hole 320 and a second, threaded hole 322. Each of the holes 320 and 322 opens through a respective exposed clamping face 325 on a respective end of the rigid frame 318. As best seen in FIG. 4A, a through hole 327 opens through the rubber material 326 from impacting surface 330 to the through hole 320. Referring back to FIG. 3A, it can be seen that the disc 110 may be clamped to a shaft by bringing the two disc portions 302*a* and 302*b* together about the shaft such that the through hole 320 in the portion 302*a* faces the threaded portion 322 in the portion 302*b*, and the through hole 320 in the portion 302*b* faces the threaded portion 322 in the disc portion 302*a*. The two portions 302*a* and 302*b* are clamped by threaded screws 304 that are inserted through the through holes 327, 320, threaded ends first, and then threaded to the respective threaded holes 322 in the opposing disc portions. This securely clamps the disc 110 to a shaft.

Secure clamping is provided, in this regard, by the exposed opposing clamping faces 325, over which the rubber material 326 does not extend. Thus, where the clamping force is applied, the clamping faces 325 of the rigid frames 318 within the opposing disc portions 302*a* and 302*b* are brought together in contact to provide a stiff, nonyielding clamping interface. In addition, the planar sections 310, which are part of the rubber material 326, are squeezed between the metal shaft and corresponding portions 310*a* of the rigid member 318. This compresses these planar sections 310 to such an extent that the disc 110 is firmly clamped to, and cannot slide along a shaft. Now, if the disc 110 is damaged and must be repaired or replaced, it can be dissembled from the shaft by dethreading the screws 304, removing the portions 302*a* and 302*b* and replacing either or both.

Two significant advantages of the disc configuration illustrated in FIG. 3A are evident. First, the clamping force exerted by the screws 304 is not parallel to any of the planar sections 310 of the inner opening of the disc 110 and therefore is not parallel to any of the surface portions of the shaft 108 or 112. In other words, there is a component of a clamping force vector that is normal to the interface between each of the clamping planar sections 310 and the shaft 108 or 112. This advantageously distributes the clamping force around the interface between the inner opening of the disc 110 and the shaft 108 or 112. Second, the plane 306 where the disc portions 302*a* and 302*b* are brought together defines a minute seam that extends to respective opposing flat portions of the impacting surface 330. This is best seen in FIGS. 3A and 3C. Since the impacting surface 330 tends to contact the material stream at the corners 314, filaments, such as strings or threads are less likely to snag in the seams than if they were located at the corners of the disc 10.

Figure 5A:
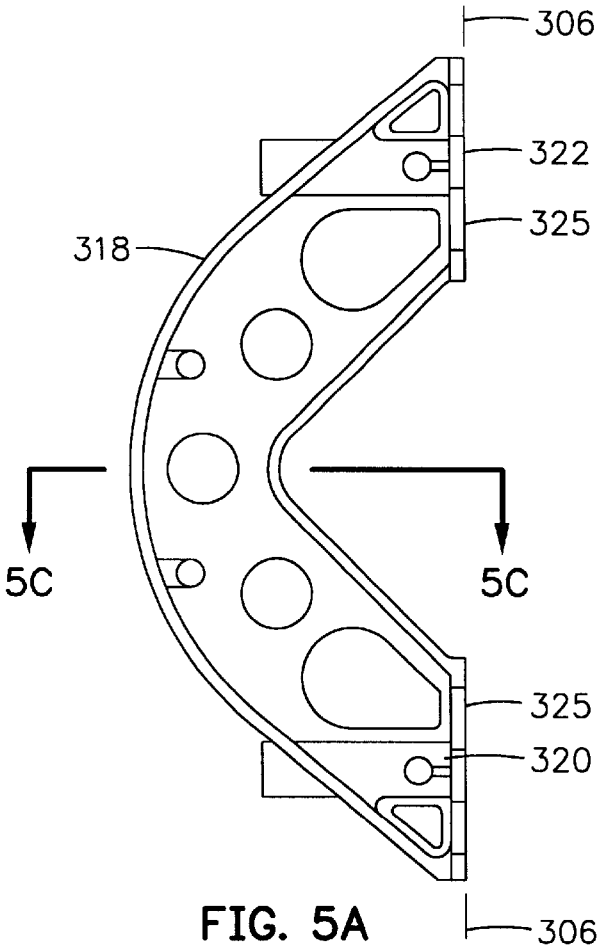
FIG. 5A is a side elevation view of a rigid frame or an embedment in the one piece of FIG. 4A.
Figure 5B:
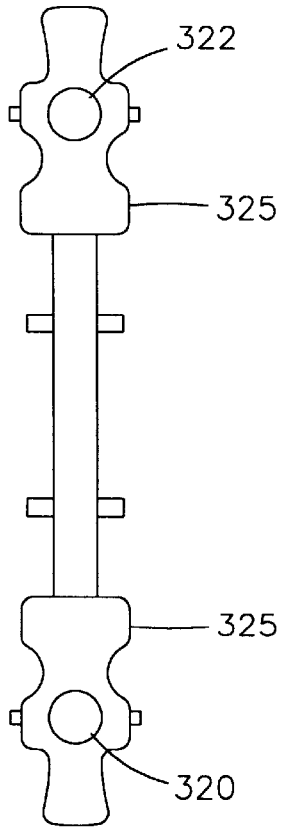
FIG. 5B is a front elevation view of the embedment of FIG. 5A.
Figure 5C:
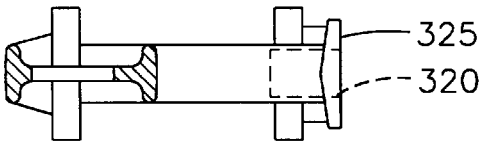
FIG. 5C is a sectional view of the embedment of FIG. 5A, taken along C—C of FIG. 5A.

The rigid frame 318, shown in FIG. 5A–5C, may be made of metal, such as steel or aluminum, or a rigid plastic. In the preferred embodiment, the rigid frame is made from 356 aluminum casting that has been heat treated.

FIGS. 7A–7C and 8A–8B show construction of details of the rotatable shafts 108, 112 which are represented by a shaft assembly 400. The shaft assembly 400 consists of a central axle tube 402 and two end spindle assemblies 404, each disposed partially in the tube 402, near an end. In the illustrative embodiment, the axle tube 402 has a square cross-section to which the disc 110 is clamped (see FIG. 3A). The center of the axle tube 402 is generally hollow. Each spindle assembly 404 is constructed to mount within a respective end of the axle tube 402. The spindle assembly 404 is comprises a central spindle 406 and attachment discs 408. One end of the central spindle 406 is dimensioned to fit inside an end of the axle tube 402 while the exposed end of the spindle 406 is dimensioned to attach to a disc screen apparatus. In the present invention, the exposed spindle ends are sized to be compatible with the rotation bearings 140, drive sprockets 142 and rotation sprockets 144 of the apparatus 100. The attachment discs 408 are initially dimensioned to be larger than the central opening 410 of the axle tube 402. In the configuration shown in FIG. 7 and 8, the attachment disc 408 is circular in shape with a circular center opening that is sized to fit over the spindle 406. One or more attachment discs 408 are welded to the spindle 406 to form the spindle assembly 404. The spindle assembly 404 is then positioned in a fixture where the attachment discs 408 are machined to press fit into the central opening 410. Once sized, the spindle assembly 404 is press fit into the opening 410 a set distance. The attachment discs 408 are used to center and align the spindle 406 along the axis 414 of the shaft. A plurality of holes 412 in the axle tube 402 are used to weld the attachment discs 408 in place, thus securing the spindle assembly 404 in the axle tube 402, forming the axle assembly 400. The axle tubes 402, spindles 406 and attachment discs 408 are preferably made from high strength materials, such as steel.

While the invention herein disclosed has been described by means of specific embodiments and applications thereof, numerous modifications and variations could be made thereto by those skilled in the art without departing from the scope of the invention set forth in the claims. For example, the discs may have shapes other than the square one shown, and may have central openings that have eccentric shapes including curved ones such as ellipses and regular ones such as triangles, quadrilaterals, and polygons.

I claim:

1. A disc for attachment to a shaft in a disc screen apparatus comprising:

an inner rigid frame;

an outer material partially covering the rigid frame; and wherein the disc has an outer perimeter which is substantially square with radiused corners.

2. The disc of claim 1 further comprising;

a cylindrical boss extending from at least one side of the disc, the boss having a thickness and an outer perimeter.

3. The disc of claim 2 wherein an outer perimeter impact surface of the disc is greater than the outer perimeter of the boss.

4. The disc of claim 1 wherein the radiused corners have a texture.

5. The disc of claim 1 wherein the disc includes a first portion and a second portion configured to be coupled together around a shaft.

6. The disc of claim 5 wherein the disc further comprises;

a disc parting plane separating the disc into a first portion and second portion, each portion containing a fraction of the rigid frame such that when the first and second portions are joined, a joining surface of the fraction of the rigid frame in the first half contacts a joining surface of the fraction of the rigid frame in the second half.

7. The disc of claim 1 wherein the outer material is compression molded around the rigid frame.

8. The disc of claim 1 wherein the outer material includes rubber.

9. The disc of claim 1 wherein the rigid frame is made of metal.

10. A disc for releasable attachment to a shaft in a disc screen apparatus for classifying mixed recyclable materials, comprising:

an inner rigid frame;

a flexible material covering the rigid frame, the flexible material having high abrasion resistance for impacting recyclable materials to be classified and having a high co-efficient of friction for engaging and propelling the materials in a conveying direction along a disc screen;

the inner rigid frame and the outer material covering the frame being separable into a plurality of portions, the portions of the inner rigid frame being configured to provide an opening for receiving a shaft of the disc screen apparatus;

means for releasably clamping the inner rigid portions around the shaft; and wherein the portions made of flexible material define an outer impacting surface with a generally square shape including rounded corners connected by flat portions.

11. The disc of claim 10 wherein the portions made of flexible material have a seam that extends to opposing flat portions of the impacting surface.

12. The disc of claim 10 wherein the shaft receiving opening is square and the clamping means includes a pair of bolts that extend on either side of the shaft parallel to a diagonal of the square shaft.

13. The disc of claim 10 wherein the inner rigid frame is made of metal and the flexible material is a rubber material molded to the inner rigid frame.

14. A disc for releasable attachment to a shaft in a disc screen apparatus for classifying mixed recyclable materials, comprising:

an inner rigid frame;

an outer material partially covering the rigid frame and defining an outer impacting surface with a generally square shape for engaging and propelling mixed recyclable materials in a conveying direction along a disc screen;

the inner rigid frame and the outer material covering the frame being separable into a plurality of portions, the portions being configured to provide an opening for receiving a shaft of the disc screen apparatus; and means for releasably clamping the portions around the shaft.

15. A disc for releasable attachment to a shaft in a disc screen apparatus for classifying recyclable materials, comprising:

a flexible material defining an outer impacting surface shaped for engaging and propelling mixed recyclable materials in a conveying direction along a disc screen apparatus;

a rigid frame embedded within the flexible material and extending a substantial radial distance within the flexible material to impart stiffness;

the flexible material and the inner frame being separable into a plurality of portions that can be assembled around a shaft of the disc screen apparatus; and means for releasably clamping the portions around the shaft.

* * * * *